United States Patent [19]

Alley et al.

[11] Patent Number: 4,741,448

[45] Date of Patent: May 3, 1988

[54] CONTAINER WITH BUOYANT FLUID FLOW RESTRICTOR

[75] Inventors: Kenneth A. Alley, R.D. 4, Box 4820, Aliramo Estate, Berwick, Pa. 18603; Jonothon M. W. McIntyre, Van Nuys, Calif.

[73] Assignee: Kenneth Ali Alley, Burbank, Calif.

[21] Appl. No.: 57,440

[22] Filed: Jun. 2, 1987

[51] Int. Cl.[4] ..... B65D 39/06

[52] U.S. Cl. ..... 215/266; 222/564

[58] Field of Search ..... 215/264, 265, 266, 267, 215/268; 141/363, 366; 222/564, 547

[56] References Cited

U.S. PATENT DOCUMENTS

| | | | |
|---|---|---|---|
| 8,372 | 8/1878 | Codd | 215/266 |
| 42,188 | 4/1864 | Hamilton | 215/266 |
| 45,373 | 12/1864 | Beard et al. | 215/266 |
| 133,883 | 12/1872 | Parkhurst | 215/264 |
| 188,293 | 3/1877 | Hicks | 215/266 |
| 272,775 | 2/1883 | Roorbach | 215/266 |
| 317,705 | 5/1885 | Beardsley | 215/266 |
| 320,189 | 6/1885 | Stewart | 215/266 |
| 320,701 | 6/1885 | Roorbach | 215/266 |
| 365,961 | 7/1887 | Beardsley | 215/266 |
| 1,079,403 | 11/1913 | Crecelius | 215/266 |
| 1,591,623 | 7/1926 | Hassensall | 222/185 |
| 1,858,758 | 5/1932 | Wolfe | 222/192 X |
| 4,125,200 | 11/1978 | Manley | 215/266 X |

*Primary Examiner*—Donald F. Norton

*Attorney, Agent, or Firm*—Kelly, Bauersfeld & Lowry

[57] ABSTRACT

A buoyant ball as provided within a water bottle to provide a momentary gate for restricting water flow out of the bottle as it is inverted. When filling the bottle with water, the ball floats on the surface and eventually comes to rest at the base of the bottleneck. Due to irregularities in the bottle, water flow past the ball is not prevented, but is restricted. As the bottle is inverted to permit water to escape therefrom, some water leaks past the ball through the neck and out of the bottle, but the ball remains positioned at the base of the bottleneck. The ball can be dislodged from the neck by an exterior blow to the bottle, or it will dislodge itself with the passage of time.

18 Claims, 2 Drawing Sheets

FIG. 5
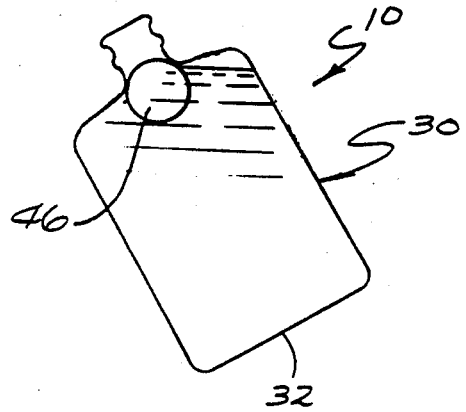
FIG. 6
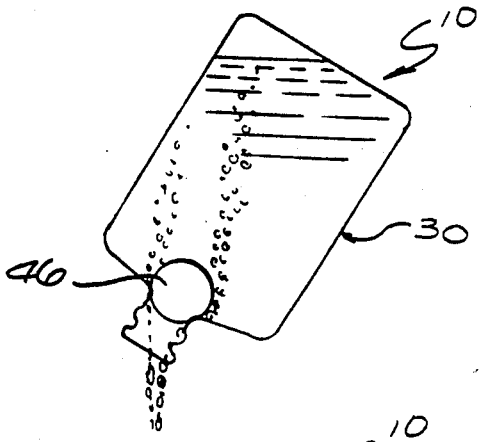
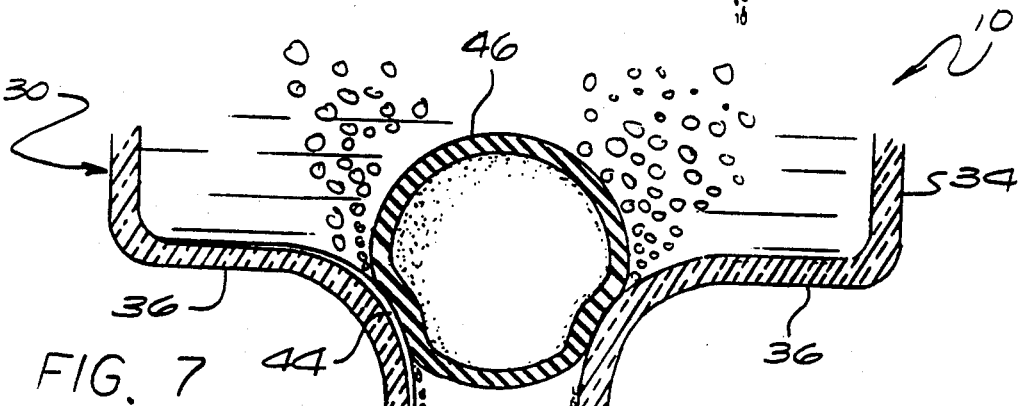
FIG. 7
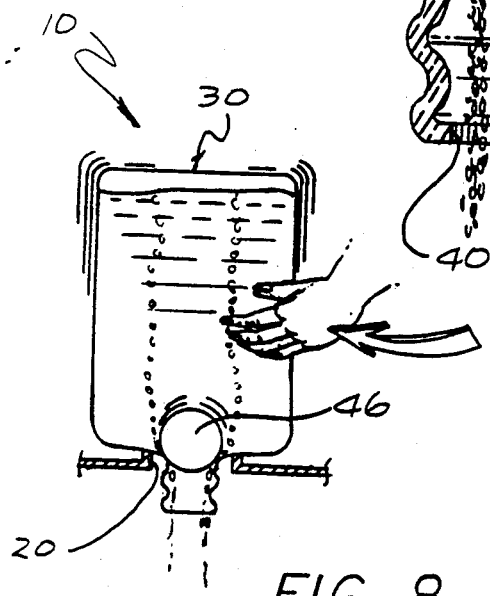
FIG. 8
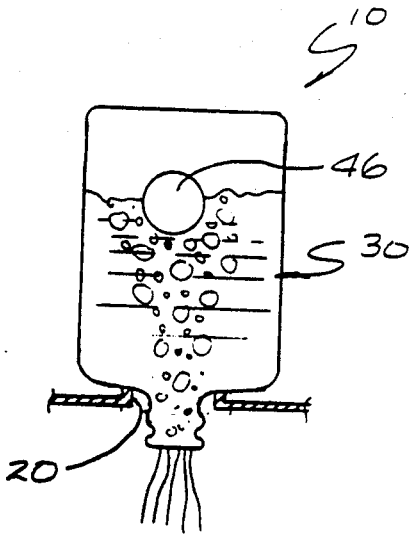
FIG. 9

CONTAINER WITH BUOYANT FLUID FLOW RESTRICTOR

BACKGROUND OF THE INVENTION

This invention relates generally to devices for controlling fluid flow out of a bottle or other fluid container. More specifically, this invention relates to a momentary gate for restricting fluid flow through an upper container port as the container is inverted.

It has been estimated that one of every eighteen homes is presently equipped with some type of fluid dispensing apparatus, such as an electric water cooler. Moreover, many modern offices are likewise equipped with water dispensing devices to provide employees convenient access to hot and cold drinking water.

Most water dispensing systems typically utilize a standard five gallon bottle which has a bottleneck at its upper end which forms an outlet port for water stored inside. Before placing the bottle on the water dispenser, a seal over the port must be removed, and then the bottle simultaneously lifted and inverted to orient the bottleneck vertically downwardly to permit the gravitational flow of water into the dispenser. A problem experienced by many users of such water dispensing systems involves spillage of water onto floors, carpets, walls, and furniture while the bottle is inverted and before being securely placed on the dispenser. Such spillage can pose a serious safety hazard in some instances, and further creates the possibility of needless damage to property.

Accordingly, there has been a need for a novel device capable of restricting flow out of water bottles or other fluid containers while they are inverted, but which will not interfere with normal flow of the fluid out of the container after the container has been securely positioned where intended. Further, such a novel flow restriction device should have characteristics which permit an automatic release of the flow restriction, or alternatively permit manual disengagement of the outlet port occlusion. Additionally, a novel flow restriction device for use specifically with water bottles is needed which can be adapted for use with existing bottles, and which involves minimal expense for installation or modification. The present invention fulfills these needs and provides other related advantages.

SUMMARY OF THE INVENTION

The present invention resides in a novel momentary gate for fluid containers which effectively restricts fluid flow through an upper container port as the container is inverted. The momentary gate is incorporated into a novel fluid container comprising bottle means having a tapered fluid port at an upper end through which fluid passes to fill or empty the container, and means within the bottle means for momentarily restricting fluid flow out of the port when the bottle means is inverted. This restricting means has a construction such that when the bottle means is filled with fluid in a upright position, the fluid is permitted free passage through the port until the bottle means is substantially full, at which time the port becomes substantially occluded by the restricting means. When the bottle means is inverted, some passage of fluid is permitted past the restricting means, yet the port remains substantially occluded until either the fluid pressure at the port reduces sufficiently so that the restricting means disengages to permit the fluid to flow without obstruction through the port, or the bottle means is given an exterior blow.

In a preferred form of the invention, the novel fluid container is intended for use in connection with a water conditioning unit. Such typical water conditioning units have means for receiving and holding the fluid container in an inverted position thereon to permit gravitational flow of water into the interior of the water conditioning unit. Water so placed within the conditioning unit can be dispensed on demand.

The water container includes a standard cylindrical bottle having a tapered fluid port at an upper end through which fluid passes to fill or empty the container. Means are provided within the bottle for momentarily restricting fluid flow out of the port as the bottle is inverted and placed on the water conditioning unit. This restricting means includes a generally spherical, flexible and resilient ball which is buoyant in the water, which ball has a diameter greater than a diameter of the tapered fluid port of the bottle. The restricting means further includes ridge means which, in connection with the ball when positioned in engagement with the port to restrict flow therethrough, defines a fluid passageway to ensure leakage of fluid past the ball when the bottle is inverted.

The ball will remain in place to substantially occlude the bottle port and restrict flow therethrough until the buoyant characteristics of the ball overcome the fluid pressure bearing downwardly on the ball and the frictional engagement between the ball and the bottle. When such a condition is reached, the ball simply floats upwardly through the water and thus permits the fluid to flow without obstruction through the port. This process will occur automatically over a short period of time after the bottle has been inverted, or can be caused to occur immediately after the bottle has been inverted by giving the bottle a sharp external blow.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 5 is an elevational view of the water bottle illustrated in FIG. 2, showing how the buoyant ball remains in place to restrict flow through the bottleneck as the bottle is initially tilted;

FIG. 6 is a view of the water bottle similar to FIG. 5, illustrating the manner in which the ball retains its position but allows fluid leakage through the bottleneck as the bottle is further rotated;

FIG. 7 is an enlarged sectional view taken generally along the line 4—4 of FIG. 3, further illustrating the manner in which the momentary buoyant gate restricts flow through the bottleneck after the bottle has been fully inverted and placed on the water dispenser;

FIG. 8 is a view of the water bottle similar to FIGS. 5 and 6, illustrating the manner in which a sharp exterior blow can be delivered to the water bottle for the purpose of disengaging the ball from a portion of the bottle adjacent the bottleneck; and FIG. 9 is a view similar to FIG. 8, illustrating the result of the ball disengaging from the bottleneck to permit fluid to flow freely through the outlet port.

DETAILED DESCRIPTION OF THE PREFERRED EMBODIMENT

Figure 1:
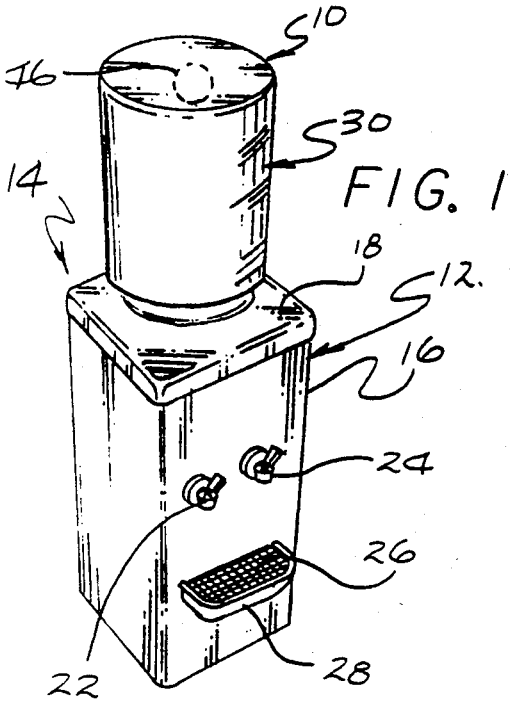
FIG. 1 is a perspective view of a water dispensing station including a water container embodying the invention.

As shown in the drawings for purposes of illustration, the present invention is concerned with a novel water container generally designated in the accompanying drawings by the reference number 10. Such a water container 10 is intended to be used in connection with a water conditioning unit 12 (FIG. 1), to complete a fluid dispensing station 14. The exemplary water conditioning unit 12 is constructed to include a generally rectangular housing 16 having a top 18 which can be removed to gain access to the interior of the conditioning unit 12. An enlarged aperture 20 (FIGS. 7 through 9) is provided through this top 18 to receive water from the water container 10, by means of gravitational flow, into the interior of the housing 16. The conditioning unit 12 further includes hot and cold water spigots 22 and 24 for the on-demand dispensing of conditioned water. A grating 26 is provided for supporting a water receptacle (not shown) immediately below either or both of the hot and cold water spigots 22 and 24, and this grating is positioned by and immediately above a water overflow catch basin 28.

As will become apparent from the description below, the novel container 10 of the present invention provides means for restricting the flow of water out of the container as it is inverted, but which does not interfere with normal flow of the water out of the container after it has been positioned over the aperture 20 of the water conditioning unit 12. Thus spillage of water onto floors, carpets, walls and furniture while the bottle is being inverted, is minimized. This advantageously alleviates some potential safety hazards which can arise due to the uncontrolled flow of water out of the container 10 as it is being lifted and inverted to place it on to the conditioning unit 12.

Figure 2:
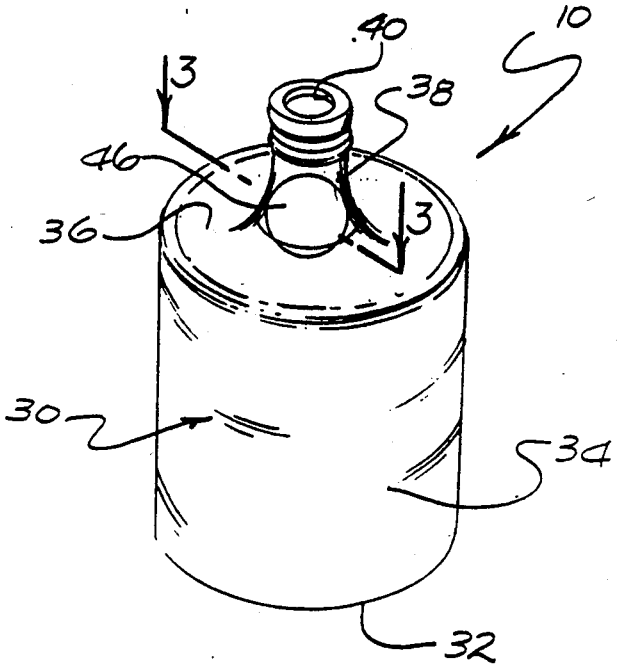
FIG. 2 is a perspective view of the water container shown in FIG. 1, illustrated as it is typically stored in an upright configuration.
Figure 3:
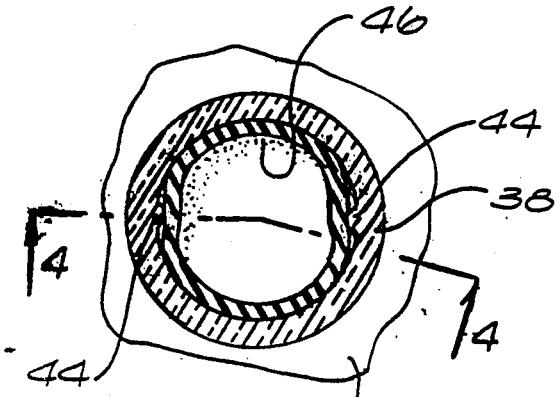
FIG. 3 is an enlarged, sectional view taken generally along the line 3—3 of FIG. 2, illustrating the manner in which a buoyant ball engages a neck portion of a bottle and is deformed by a ridge to permit fluid leakage through the bottleneck when the bottle is inverted.
Figure 4:
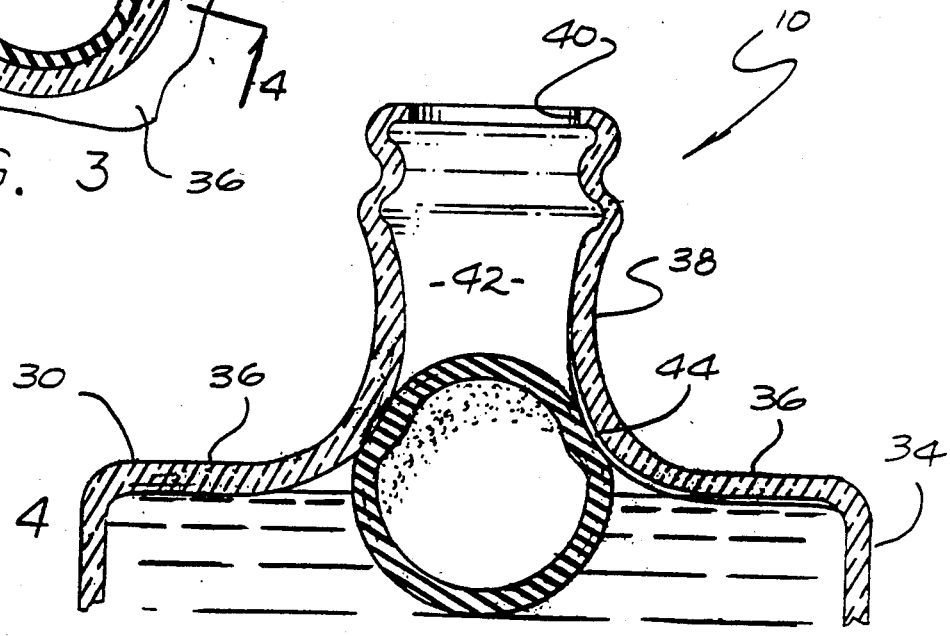
FIG. 4 is an enlarged, fragmentary sectional view taken generally along the line 4—4 of FIG. 3, further illustrating the manner in which the buoyant ball restricts flow through the bottleneck.

In accordance with the present invention, and as illustrated best in FIGS. 2 through 4, the novel water container 10 includes a bottle 30 having a generally horizontal bottom wall 32, a cylindrical horizontal wall 34 extending upwardly therefrom, an upper shoulder 36, and a bottleneck 38. At the top of the bottleneck 38 is an opening 40 through which water passes to fill or empty the container 10. The shoulder 36 and the bottleneck 38 together form a tapered fluid port 42 through which the water must flow as it enters or exits the bottle 30.

The lower portion of this tapered fluid port 42, defined generally by the intersection of the shoulder 36 and the bottleneck 38, includes a slight imperfection in the form of a pair of small inwardly facing ridges 44 integrally formed with the bottle 30. These ridges 44 are essentially created during the molding process of the plastic bottle 30. These ridges 44 have the effect of disrupting the otherwise circular cross-sectional inner-periphery of the tapered fluid port 42 (see FIG. 3).

The novel water container 10 further includes a generally spherical, flexible and resilient ball 46 which is buoyant in water. In order to prevent passage of the ball 46 out of the bottle 30 under normal circumstances, the diameter of the ball is greater than the narrowest diameter of the bottleneck 38. More specifically, in the drawings of the container 10 is designed to hold five gallons of water. The average inner diameter of the bottleneck 38 is 19/16″. The diameter of the ball 46, on the other hand is 2¼″. The ball 46 is constructed of a fibrous rubber material having a grainy surface texture tending to momentarily frictionally interact with the bottle 30 in a manner to be described below. Further, the ball has an approximate density of 0.45 grams per cubic centimeter.

With the introduction of water into the bottle 30, the ball 46 will float on the upper fluid surface. When the container 10 is placed in an upright position during the water filling process, the ball 46 will not interfere with the free passage of water through the opening 40 or through the bottleneck 38. As the water level within the bottle 30 nears the shoulder 36, the taper between the shoulder 36 and the bottleneck 38 will tend to position the ball 46 in a location which will severely restrict the flow of fluid out of the bottle 30 unless the ball 46 is displaced (see FIG. 2). When the ball 46 is so positioned, it interacts with the surrounding portion of the bottle 30, and is slightly deformed by the ridges 44 to insure that a seal is not created which would prevent fluid flow out of the bottle 30 when the container 10 is inverted (see FIG. 3).

From the foregoing, it is to be understood that when the bottle 30 is filled with water in an upright position, the water is permitted to freely flow into the bottle until it becomes substantially full. At that time the outlet port 42 of the bottle 30 becomes substantially occluded by the interaction of the ball 46 with the adjacent portions of the shoulder 36, bottleneck 38 and the ridges 44. At this point the momentary buoyant gate is created. Thus, when the bottle is inverted, some passage of water is permitted past the ball 46 through the bottleneck 38 and out the opening 40, yet the bottle outlet port 42 remains substantially occluded.

The ball 46 will remain in the position shown until the buoyant characteristics of the ball overcome the fluid pressure bearing downwardly on the ball and the frictional engagement cohesiveness between the ball and the adjacent portions of the bottle 30. When the buoyant characteristics overcome these other factors, the ball 46 simply floats upwardly through the water, and thus permits the fluid to flow without obstruction through the bottleneck 38 and out the bottle opening 40. Alternatively, the ball 46 can be dislodged from its flow-restricting position by simply giving the bottle 30 a sharp external blow.

The manner in which the momentary buoyant gate of the present invention functions to restrict water flow out of the bottle 30 as it is inverted will described in more detail with reference to FIGS. 5 through 9. With reference initially to FIG. 2, however, it should be understood that several forces bear upon the ball 46 to initially position the ball as shown, and to also create a desired momentary adhesiveness between the ball and the bottle 30. The two primary factors are the buoyancy of the ball 46 within the water, and the physical surface textures of both the ball 46 and the interior of the bottle 30. By varying the physical surface textures of the ball 46 and/or the interior of the bottle 30, the cohesive compatibility of these two elements can be changed to adjust the momentary adhesiveness between the two to a desired level.

With reference now to FIG. 5, as the container 10 is tilted from the normal upright position toward the water conditioning unit 12, the frictional interaction between the ball 46 and the bottle 30, together with the buoyancy of the ball within the water, will tend to hold the ball in the desired position. As the container 10 is further rotated as illustrated in FIG. 6, the natural buoyancy of the ball 46 is counteracted by the surface cohesiveness between the ball and the bottle 30, and the weight of the water over the ball within the container 10. It is important, however, that some fluid be allowed to flow through the passageway provided between the ball 46 and the ridges 44, to ensure that the ball will be dislodged from its occluding position as desired.

As shown in FIG. 7, after the container 10 has been fully inverted and placed upon the water conditioning unit 12, the ball 46 remains in its flow-restricting position to substantially occlude the tapered fluid outlet port 42, and water is still allowed to flow through the passageway between the ball and the ridges 44. At this point, the user may desire to immediately dislodge the ball 46 from its occluding position to permit water to flow freely through the bottleneck 38 and into the water conditioning unit 12. In this case, the bottle 30 would be given a sharp exterior blow, such as by a users hand or fist (FIG. 8), which has the effect of disturbing the equilibrium of forces tending to hold the ball 46 in place. This disruption of forces permits the buoyancy of the ball 46 to overcome the frictional cohesiveness between the ball and the inner surface of the bottle 30, and permit it to rise freely through the water to its upper surface.

Even in the absence of a sharp exterior blow to dislodge the ball 46, as the water level within the bottle 30 drops due to seepage past the ball, the downward pressure on the ball will decrease to a point sufficient to allow the natural buoyancy of the ball to overcome the other forces interacting thereon. Thus, with or without an external blow to the bottle 30, the ball 46 will eventually dislodge itself from the inner-surface of the bottle 30, and permit the water to flow without obstruction through the outlet port 42.

From the foregoing it to be appreciated that the novel momentary buoyant gate incorporated into the container 10 of the present invention is capable of restricting flow out of the container 10 while it is inverted, but does not interfere with normal flow of the water out of the container after it has been securely positioned onto the conditioning unit 12. The momentary buoyant gate can further be adapted for use with existing bottles 30 at a minimum expense. Moreover, it should be understood that the particular materials used to construct the bottle 30 or the ball 46 can be widely varied to obtain the specific momentary cohesiveness desired to obtain optimum performance in the particular fluid medium utilized.

Although a particular embodiment of the invention has been described in detail for purposes of illustration, various modifications may be made without departing from the spirit and scope of the invention. Accordingly, the invention is not to be limited, except as by the appended claims.

We claim:

1. A novel fluid container for use in connection with a fluid dispensing station, the container comprising:

bottle means having a tapered fluid port at an upper end through which fluid passes to fill or empty the container; and means within the bottle means for momentarily restricting fluid flow out of the port when the bottle means is inverted, the restricting means having a construction such that when the bottle means is filled with fluid in an upright position, the fluid is permitted free passage through the port until the bottle means is substantially full at which time the port becomes substantially occluded by the restricting means, and when the bottle means is inverted some passage of fluid is permitted past the restricting means yet the port remains substantially occluded until the fluid pressure at the port reduces sufficiently so that the restricting means disengages to permit the fluid to flow without obstruction through the port.

2. A fluid container as set forth in claim 1, wherein the restricting means is enclosed by the bottle means.

3. A fluid container as set forth in claim 1, wherein the restricting means includes a generally spherical, flexible and resilient ball which is buoyant in the fluid, which ball has a diameter greater than a diameter of the bottle means port.

4. A fluid container as set forth in claim 3, wherein the restricting means includes means situated on the inner surface of the bottle means, for preventing the ball from forming a fluid-tight seal over the port.

5. A fluid container as set forth in claim 4, wherein the means for preventing the ball from forming a fluid-tight seal over the port includes ridge means which, in connection with the ball when positioned in engagement with the port to restrict flow therethrough defines a fluid passageway to ensure leakage of fluid past the ball when the container is inverted.

6. A fluid container as set forth in claim 5, wherein the ball flexibly deforms when engaged by the ridge means.

7. A water container for use in connection with a water conditioning unit having means for receiving and holding the water container in an inverted position thereon to permit gravitational flow of water from the bottle into the interior of the water conditioning unit, whereupon the water can be dispensed on demand, the water container comprising:

a generally cylindrical bottle having a tapered fluid port at an upper end through which fluid passes to fill or empty the container; and means within the bottle for momentarily restricting fluid flow out of the port as the bottle is inverted and placed on the water conditioning unit, the restricting means including a generally spherical, flexible and resilient ball which is buoyant in water, which ball has a diameter greater than a diameter of the tapered fluid port, and means situated on the inner surface of the bottle for preventing the ball from forming a fluid tight seal over the port such that when the bottle is filled with water in a upright position the water is permitted free passage through the port until the bottle is substantially full at which time the port becomes substantially occluded by the ball, and when the bottle is inverted some passage of water is permitted past the restricting means yet the port remains substantially occluded until the buoyant characteristics of the ball overcome the fluid pressure bearing downwardly on the ball and the frictional engagement between the ball and the bottle, so that the ball floats upwardly and thus permits the fluid to flow without obstruction through the port.

8. A water container as set forth in claim 7, wherein in the restricting means will disengage and the ball will float upwardly through the water to permit unobstructed fluid flow through the port when the bottle is given a sharp external blow.

9. A water container as set forth in claim 8, wherein the restricting means will disengage in the absence of an external blow to the bottle to permit the water to flow without obstruction through the port, when the water pressure at the port is reduced sufficiently, through leakage past the restricting means, to cause to the ball to float upwardly through the water.

10. A water container as set forth in claim 9, wherein the means for preventing the ball from forming a fluid-tight seal over the port includes ridge means which, in connection with the ball when positioned in engagement with the port to restrict flow therethrough, defines a fluid passageway to insure leakage of fluid past the ball when the container is inverted.

11. A water container as set forth in claim 10, wherein the tapered fluid port forms a bottleneck intended to be placed within the fluid dispensing station when the bottle is inverted, and wherein the upper end of the bottle is tapered upwardly toward the bottleneck to facilitate positioning of the ball over the port to restrict fluid flow therethrough.

12. A novel fluid container for use in connection with a fluid dispensing station, the container comprising:

bottle means having a tapered fluid port at an upper end through which fluid passes to fill or empty the container; and means within the bottle means for momentarily restricting fluid flow out of the port when the bottle means is inverted, the restricting means having a construction such that when the bottle means is filled with fluid in a upright position the fluid is permitted free passage through the port until the bottle means is substantially full at which time the port becomes substantially occluded by the restricting means, and when the bottle means is inverted some passage of fluid is permitted past the restricting means yet the port remains substantially occluded until the bottle means is given an exterior blow sufficient to cause the restricting means to disengage and thus permit the fluid to flow without obstruction through the port.

13. A fluid container as set forth in claim 12, wherein the restricting means includes a generally spherical, flexible and resilient ball which is buoyant in the fluid, which ball has a diameter greater than a diameter of the bottle means port, and wherein the restricting means further includes means situated on the inner surface of the bottle means for preventing the ball from forming a fluid-tight seal over the port.

14. A fluid container as set forth in claim 13, wherein the means for preventing the ball from forming a fluid-tight seal over the port includes ridge means which, in connection with the ball when positioned in engagement with the port to restrict flow therethrough, defines a fluid passageway to ensure leakage of fluid past the ball when the container is inverted.

15. A fluid container as set forth in claim 14, wherein the ball flexibly deforms when engaged by the ridge means.

16. A fluid container as set forth in claim 13, wherein the bottle means is generally cylindrical, and the fluid port forms a bottleneck intended to be placed within the fluid dispensing station when the bottle means is inverted.

17. A fluid container as set forth in claim 16, wherein the upper end of the bottle means is tapered upwardly toward the bottleneck to facilitate positioning of the ball over the port to restrict fluid flow therethrough.

18. A fluid container as set forth in claim 12, wherein the restricting means will disengage in the absence of an exterior blow to the bottle means to permit the fluid to flow without obstruction through the port, when the fluid pressure at the port is reduced sufficiently, through leakage past the restricting means, to cause the ball to float upwardly through the fluid.

* * * * *